US005479671A

United States Patent [19]

Stubler et al.

[11] Patent Number: 5,479,671

[45] Date of Patent: Jan. 2, 1996

[54] METHODS AND DEVICES FOR INSTALLING DISCONTINUOUS SHEATHS ON CABLES AND TO CABLES THUS SHEATHED

[75] Inventors: Jérôme Stubler, Paris; Patrick Ladret, Vaulx-en-Velin; Joël Dupuis, Les Essarts le Roi, all of France

[73] Assignee: Freyssinet International et Cie, Villacoublay, France

[21] Appl. No.: 345,436

[22] Filed: Nov. 21, 1994

[30] Foreign Application Priority Data

Nov. 22, 1993 [FR] France ..... 93 13941

[51] Int. Cl.[6] ..... E01D 19/10; F16L 3/00

[52] U.S. Cl. ..... 14/22; 52/223.14; 14/74

[58] Field of Search ..... 14/18–23, 74, 14/77.1; 52/223.14; 57/250

[56] References Cited

U.S. PATENT DOCUMENTS 4,569,708 2/1986 Tanaka et al. ..... 14/22 X
4,612,680 9/1986 Daiguji ..... 14/22
4,837,885 6/1989 Yang ..... 14/21

FOREIGN PATENT DOCUMENTS 0169276 1/1986 European Pat. Off. .
2660332 10/1991 France .
3234246 3/1984 Germany .

*Primary Examiner*—Ramon S. Britts
*Assistant Examiner*—James A. Lisehora
*Attorney, Agent, or Firm*—Larson and Taylor

[57] ABSTRACT

This relates to a bridge stay formed by a cable (1) which itself is surrounded by a discontinuous sheath composed of identical successive tubular sections (4) having ends which fit together (at 9). This stay comprises an inextensible cablet (10) pulled taut along the cable, on the inside of the successive sheath sections, which cablet is fastened by equidistant fasteners (11), the number of fasteners being equal to that of the sheath sections, each fastener being fixed to a sheath section at a point on this section and the distance (D) between any two successive fasteners fastened to the cablet being equal to the distance between two identical points on two successive sheath sections, which distance is slightly less than the minimum distance envisageable for each section.

6 Claims, 1 Drawing Sheet

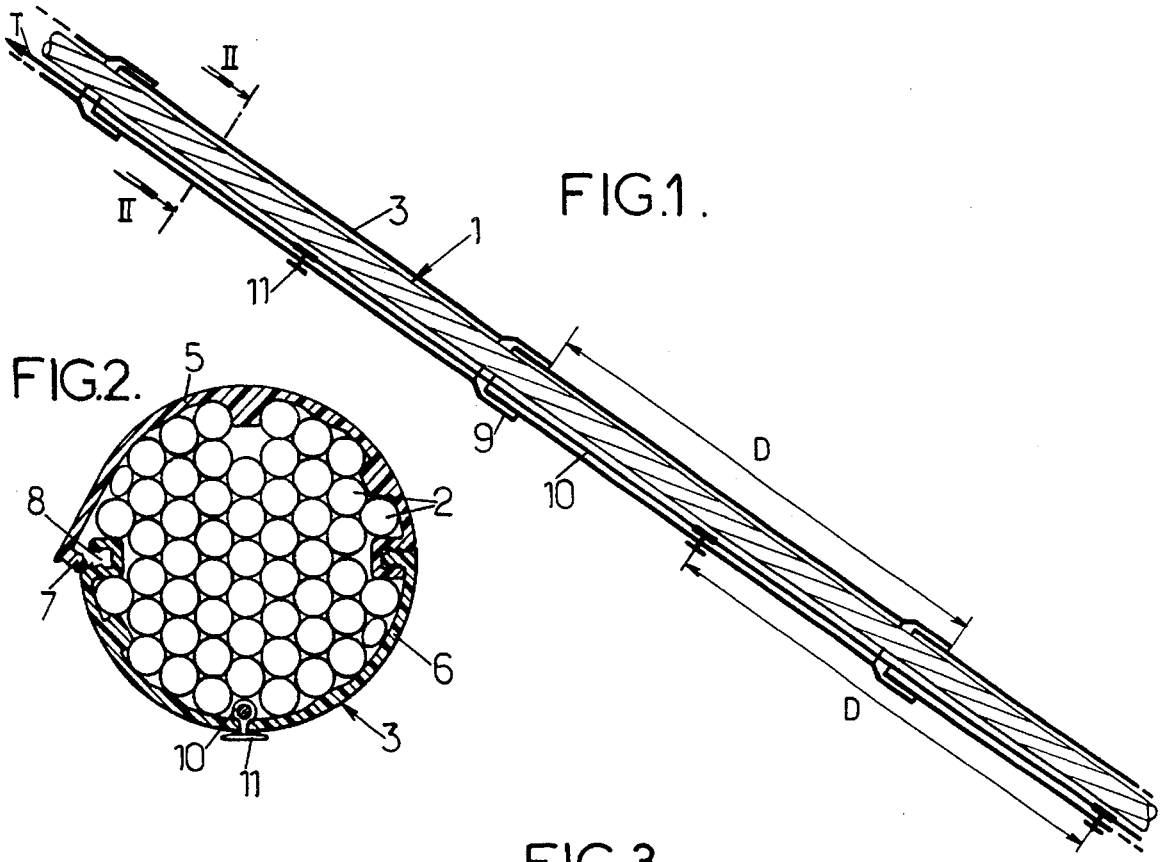
FIG.1.
FIG.2.
FIG.3.
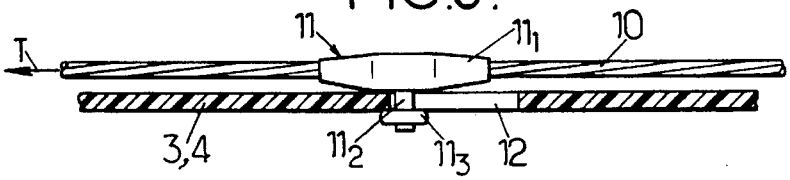
FIG.4.
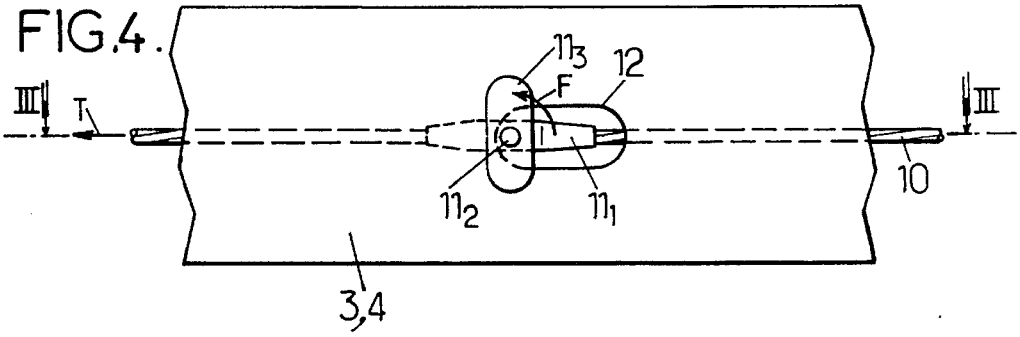
FIG.6.
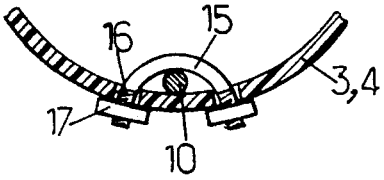
FIG.5.
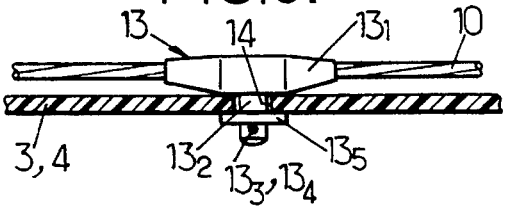

METHODS AND DEVICES FOR INSTALLING DISCONTINUOUS SHEATHS ON CABLES AND TO CABLES THUS SHEATHED

BACKGROUND OF THE INVENTION

The invention relates to methods and devices for installing discontinuous sheaths on cables, that is to say sheaths composed of identical tubular sections following on axially one after the other, as well as to the sheathed cables obtained.

It is aimed more particularly at the case where the cables in question are the cores of oblique stays and are each composed of a plurality of strands or elements which are themselves formed individually by wires or by assemblies of wires which are parallel or twisted, the said stays serving especially to equip cable-stayed bridges, connecting the towers of these bridges to their deck.

The invention is aimed more particularly still, but not exclusively, at the case where, in order to reduce the windage of each stay, its sheath has a cylindrical external profile of circular cross-section, as was described in Patent FR-A-90/04180.

The thermal expansion coefficient of the sheaths in question is generally different from that of the cables surrounded by these sheaths: in the preferred case where the sheath is formed from a plastic (such as polypropylene or high-density polyethylene), the difference between these two coefficients is considerable, that of the sheath being much higher than that of the cable.

To accommodate the thermal strains of the various sheath sections along the oblique cable which they surround, it has been proposed to provide mutual over-lapping of the contiguous ends of these sections, the lower end of each section being for this purpose widened out in the form of a bell or tulip so as to surround the upper contiguous end of the section immediately below, this accommodating the mutual sliding movements of these two ends.

It is advisable that the mutual sliding movements in question be prevented from occurring non-uniformly along the stay and from resulting in a complete disengagement of some ends of sections out of the adjacent ends and consequently leading to the thus unsheathed portions of the stay being directly exposed to the open air.

Such non-uniform sliding movements are inevitable if the sheath sections are not individually attached to the cable at their initial fitting positions: thus, under this assumption of the absence of an individual attachment, the weight of each section, due to the obliquity of the cable, tends to lower it, with sliding movements of its lower opened-out end against the overlapped upper end of the section below, and this will continue until the bottom of the said opened-out end butts up against the edge of the said overlapped end.

The disengagements resulting from such uncontrolled sliding movements have several drawbacks and, in particular, the following:

- the unsheathed portions of the stay have a high windage,
- the discontinuities which result from this are unsightly, in particular because of the fact that the strands constituting the cable are generally covered with black jackets and that the sections of external sheath are, on the contrary, generally light-coloured (grey or white),
- the cumulative displacements and strains of the various sheath sections, combined with gravitational attraction, may lead in very cold weather to these sections collecting at relatively low positions, this requiring, as a result of the subsequent expansion of the sections due to them warming up thereafter, sliding movements of relatively large magnitude of the upper sections along the cable, sliding movements which may lead to blockages and even to local ruptures, or the very least to frictional wear.

In order to remedy these drawbacks, it has already been proposed to fasten one point on each sheath section locally to the cable after first installing it onto the cable.

In the embodiments which have been proposed hitherto for ensuring such local fixing, this fixing is performed directly on site, in particular by installing a metal collar around the upper end portion, of each sheath section, which is covered by the lower flared-out portion of the section immediately above, the said collar being tightened in order to fasten it as desired.

Such an operation is tricky and expensive because of the fact that it has to be performed on site, on the already-tensioned oblique cable, in particular when the length of the cable in question is great and exceeds one hundred meters.

SUMMARY OF THE INVENTION

The object of the invention, above all, is to simplify this local fixing of each sheath section to the cable considerably by making it unnecessary for any intervention on site after the various sections have been brought into their final position on the cable.

For this purpose, the sheathed cables of the kind in question according to the invention are essentially characterized in that they comprise an inextensible cablet stretched along the cable, on the inside of the successive sheath sections, which cablet is fastened to a plurality of equidistant fasteners, the number of fasteners being equal to that of the said sheath sections, each fastener being fixed to a sheath section at a point on this section and the distance between any two successive fasteners fastened to the cablet being equal to the distance between two identical points on two successive sheath sections, which distance is slightly less than the minimum length envisageable for each section.

As a result, the relative positions of the points for fixing the various fasteners to the various sheath sections are identical.

In preferred embodiments, one and/or other of the following arrangements is/are furthermore used:

- each fastener comprises first fastening means permanently fastened to the cablet and second fastening means suitable for removably interacting with the first ones and with a portion, preferably provided for this purpose, of a sheath section so as to link these first means to this section,
- in a cable sheathed according to the preceding paragraph, the first fastening means comprise a base fastened to the cablet, a pin projecting from this base and a small elongate plate mounted so as to rotate at the end of this pin and the second fastening means comprise an oblong opening hollowed out longitudinally in the sheath section, the said oblong opening being sized so as to be able to let the small plate pass when it is oriented longitudinally and not when it is oriented transversely,
- in a sheathed cable according to the paragraph which precedes the previous one, the first fastening means comprise a base fastened to the cablet and a stud projecting radially from this base and itself being pierced close to its free end by a transverse bore and the second fastening means comprise a hole hollowed out in the sheath section and a cotter pin suitable for interacting with the bore of the stud, on the outside of the sheath section, the fastener is formed by a U-bolt suitable for straddling the cablet, the two feet of this U-bolt being suitable for passing through two holes hollowed out in the sheathed section and for having two lock nuts placed on the end of them, on the outside of this section.

As regards methods of installing the discontinuous sheaths on tensioned oblique cables, these are essentially characterized according to the invention by the series of following operations:

an inextensible cablet at least as long as the cable is employed, around this cablet and the base of the cable are successively placed each of the sections intended to form the sheath, a given point on each section is fixed locally to the said cablet, the relative positions of the points for fixing the various sections to the cablet being identical and the distance between the fixing points, which follow on one after the other along the cablet, being slightly less than the minimum length envisageable for each section, and then the cablet is pulled taut along the cable by exerting a pulling force on its upper end in such a way that, at the end of pulling, the various sheath sections follow on uniformly one after the other along the cable with mutual overlapping.

The subject of the invention is also the special components (cablets, fasteners, etc.) employed for obtaining the sheathed cables in question.

It comprises, apart from these main arrangements, certain other arrangements which are preferably used at the same time and which will be explained in more detail hereinbelow.

BRIEF DESCRIPTION OF THE DRAWINGS

In the following, a few preferred embodiments of the invention will be described, with reference to the hereinappended drawing, in, of course, a non-limiting manner.

FIG. 1 of this drawing shows, in partial diagrammatic axial section, a sheathed stay in accordance with the invention.

FIG. 2 shows, on a larger scale, a cross-section of this stay along II—II, FIG. 1.

FIGS. 3 and 4 show, on an even larger scale, a fastener embraced by the said stay, respectively along III—III, FIG. 4, and along the arrow IV of FIG. 3.

FIGS. 5 and 6 show diagrammatically two variants of such a fastener.

DESCRIPTION OF THE PREFERRED EMBODIMENTS

A cable 1 is used which is composed of a bundle of laterally juxtaposed strands 2, each of these strands 2 being itself preferably formed by an assembly of twisted wires contained in a plastic jacket with interposition of a suitable protective product.

This cable is mounted and tensioned obliquely between a high point on a bridge tower and the deck of this bridge, for the purpose of supporting this deck.

In this state, the external lateral surface of the cable presents irregularities, giving a high windage.

In order to reduce this windage, the cable 1 is surrounded by a sheath or shell 3 having a smooth cylindrical lateral surface of revolution.

For this purpose, and as explained in the French patent mentioned hereinabove, a series of sections 4 are employed, each composed of two half-shells 5, 6 made of a slightly deformable material, the longitudinal edges of which are joined in pairs.

In the preferred embodiment illustrated, these edges are joined by mutual clipping of one of the edges, having a flap 7 bent over towards the axis of the cable, against the other edge, creating a channel 8 suitable for receiving the said flap.

In order to accommodate the relative thermal strains between the shell sections 4 and the cable 1, that end of each section 4 intended to be placed at the bottom of this section after mounting is opened out in the manner of a cylindrical bell 9 suitable for overlapping, with a loose sliding-fit or with a slight radial clearance, the upper end of the section immediately below.

In order to control and render uniform the individual thermal strains of the various shell sections along the entire length of the cable (so as to avoid the drawbacks mentioned hereinabove), it is advisable to fix one point on each section to the cable portion that this section surrounds, and to do this so that mutual overlapping of the ends of contiguous sections are permanently observed, even in very cold weather.

For this purpose, use is made here of a flexible and inextensible tie 10 which is designated, in the present description, by the word "cablet".

This cablet, which is, for example, formed by a bundle of wires made of stainless steel or of a material protected from corrosion, the overall diameter of which is of the order of a few millimeters, has a length at least equal to that of the cable.

It is intended to be pulled taut along the cable, on the inside of its discontinuous sheath.

In this tensioned state, the said cablet 10 may be considered as being fastened to the cable 1 itself.

It is to this cablet that the various shell sections 4 are fixed locally.

Because of the fastening mentioned above, this fixing may be considered as being to the cable itself.

The very great advantage of this arrangement resides in the fact that the local fixing in question may be carried out in turn on the various sections, at the base of the cable, before final installation of the cablet, the latter being installed only progressively along the cable, by exerting a pulling force on its upper end, as the successive attachment of the various sections to it proceeds.

In other words, it is not necessary to carry out the said local fixing on site, along the already tensioned oblique cable, which would require particularly tricky, lengthy and expensive operations, and in particular the provision of equipment of the aerial-cableway type with suspended platforms.

It should also be noted that the pulling force exerted on the cablet 10, in order to install it along the cable 1, itself serves to hoist up each of the sheath sections to its final position around the cable.

The local fixing of the various sections to the cablet may be accomplished in any desirable manner.

In the following, a few examples of such fixing are given purely by way of illustration, of course, and implying no limitation of the invention.

In the first embodiment, depicted in FIG. 1 to 4, the cablet 10 is fastened to a plurality of fasteners 11 of the type of certain "cuff-links", suitable for interacting with elongate oblong openings 12 hollowed out longitudinally in the various shell sections 4.

Each fastener 11 comprises:

a base $\mathbf{11}_1$ fastened to the cablet 10, especially by welding, a pin $\mathbf{11}_2$ projecting radially from the base $\mathbf{11}_1$, a small elongate plate 113 mounted so as to pivot at the end of the pin $\mathbf{11}_2$, the dimensions of the small plate being chosen in such a way that it can pass through the oblong opening 12 when it is oriented longitudinally, that is to say parallel to the cablet, and in such a way that, on the contrary, the said small plate cannot pass through when it is oriented transversely.

The attachment of such a fastener to a shell section 4 takes place very simply by orienting the small plate $\mathbf{11}_3$ parallel to the cablet 10, then by inserting this small plate into the oblong hole 12 in the section 4 and, finally, rotating the said small plate through 90° (in the direction of the arrow F in FIG. 4), thereby locking the attachment.

All the oblong holes 12 are hollowed out in identical regions on the various sections 4, for example in the middle of the axial extent of each section.

It should furthermore be noted that, after tensioning the cablet 10 by exerting a pulling force T on its upper end, each pin $\mathbf{11}_2$ butts up against the upper end of the associated oblong hole 12.

This results in the points corresponding to the local fixing of the cablet to the various sections being placed at identical positions on these sections.

Under these conditions, the distance D (FIG. 1) which separates the successive fasteners 11 on the cablet 10 is equal to the distance which separates the identical points on the various successive sections from each other, for example the edges of their lower portions which are flared out in the form of a tulip.

The said distance D is given a value which is slightly less than the shortest envisageable length for each shell section 4, during very cold weather, which length is generally of the order of 2 meters.

Under these conditions, and the above equality being permanently satisfied, it is certain that:

on the one hand, the relative thermal strains of the various sections with respect to the cable occur in a uniform manner all along the discontinuous sheath created by these sections, with identical mutual overlapping of the adjacent ends of the said sections, and, on the other hand, this overlapping never becomes zero.

In the variant of FIG. 5, each fastener 13 comprises:

on the one hand, a base $\mathbf{13}_1$ fixed to the cablet 10, for example by welding, the said base being extended radially by a stud $\mathbf{13}_2$ which is itself hollowed out near its head by a transverse bore $\mathbf{13}_3$, and, on the other hand, a cotter pin $\mathbf{13}_4$ suitable for being inserted, for locking purposes, into the bore $\mathbf{13}_3$ after the head of the stud has passed through an orifice 14 hollowed out in the sheath section 4 in question.

The fixing of this section to the cablet 10 then involves the succession of the following operations:

insertion of the stud $\mathbf{13}_2$ into the orifice 14, and then insertion of the cotter pin $\mathbf{13}_4$ into the bore $\mathbf{13}_3$ of the stud, which is then placed on the outside of the said section 4.

In order to improve the distribution of the pressure of the cotter pin $\mathbf{13}_4$ on the external face of the section 4, a washer $\mathbf{13}_5$ surrounding the stud $\mathbf{13}_2$ is furthermore advantageously interposed between this cotter pin and this external face.

In the variant of FIG. 6, no base is attached in advance to the cablet 10.

This cablet is fixed to each sheath section 4 with the aid of U-bolts 15 straddling the cablet, the two feet of each U-bolt being threaded at their ends and each of these threaded ends interacting, after passing through suitable holes 16 hollowed out in the section 4, with external lock nuts 17.

This variant is advantageous in that it dispenses with attaching special equidistant fastening means to the cablet 10 in advance, but it does require an accurate measurement of the separations E between the successive portions, of the cablet 10, which are straddled by their U-bolts 15, these separations E having all to be made equal to the distance D defined hereinabove.

As a result of this, and whatever the embodiment adopted, a cable is obtained which is surrounded by a discontinuous sheath formed by a plurality of successive tubular sections, which fit together progressively, for which cable the construction, fitting and advantages, (especially the absence of any risk of local disengagement of the fitted-together sections, the elimination of any operation on site, that is to say on the tensioned cable itself at locations other than the base of this cable, and the ease with which the sections can be dismantled) result sufficiently from the foregoing.

It goes without saying, and as results moreover already from the foregoing, the invention is in no way limited to those of its modes of application and embodiments which have been more especially envisaged, on the contrary, it encompasses all variants, especially those where the locking using a cotter pin $\mathbf{13}_5$, illustrated in FIG. 5, is replaced by another removable locking means employing a C-shaped spring washer of the "circlip" type interacting with a circular groove hollowed out in the stud $\mathbf{13}_2$, flush with the exterior face of the sheath section 4 in question.

We claim:

1. A sheathed cable assembly comprising:

a cable;

a discontinuous sheath surrounding said cable composed of identical successive tubular sections having ends which fit together; and an inextensible cablet pulled taut along the cable inside the successive sheath sections, said cablet being fastened to a plurality of equidistant fasteners, the number of fasteners being equal to that of said sheath sections, each respective said fastener being fixed to a respective one of said sheath sections at a point on said one of said sheath sections and a distance between any two successive said fasteners fastened to the cablet also being equal to the distance between two identical points on two successive said sheath sections, said distance being slightly less than a minimum length envisageable for each said section.

2. The sheathed cable assembly according to claim 1, wherein each said fastener comprises first fastening means for permanently fastening each said fastener to the cablet and second fastening means for removably interacting with the first fastening means and with a portion of the respective one of said sheath sections so as to link said first fastening means to the respective one of said sheath sections.

3. The sheathed cable assembly according to claim 2, wherein the first fastening means comprises a base fastened to the cablet, a pin projecting from the base and a small elongate plate mounted so as to rotate at the end of the pin; and wherein the second fastening means comprises an oblong opening hollowed out longitudinally in the respective one of said sheath sections, said oblong opening being sized so as to be able to let the small plate pass when the small plate is oriented longitudinally and not when it is oriented transversely.

4. The sheathed cable assembly according to claim 2, wherein the first fastening means comprise a base fastened to the cablet and a stud projecting radially from the base, said stud having a free end and being pierced close to said free end by a transverse bore, and wherein the second fastening means comprises a hole hollowed out in the respective one of said sheath sections and a cotter pin interacting with the bore of the stud, on the outside of the respective one of said sheath sections.

5. The sheathed cable assembly according to claim 1, wherein the fastener is formed by a U-bolt straddling the cablet, the U-bolt having two feet passing through two holes hollowed out in the respective one of said sheathed sections and having two lock nuts placed on the end of the feet, on the outside of the respective one of said sheathed sections.

6. A method for installing, on a tensioned oblique cable, a discontinuous sheath composed of identical successive tubular sections which fit together at contiguous ends thereof comprising the steps of:

providing an inextensible cablet at least as long as the cable;

successively moving the cablet along the cable past a base of the cable and placing each of the tubular sections around said cablet and the base of the cable;

fixing a given point on each tubular section locally to said cablet, the relative positions of the points being identical on each tubular section, the points following on one after the other along the cablet, and a distance between the points being slightly less than a minimum length envisageable for each tubular section; and then pulling the cablet taut along the cable by exerting a pulling force on its upper end in such a way that, at the end of pulling, the tubular sections follow on uniformly one after the other along the cable with mutual overlapping.

* * * * *